US009537256B2

(12) United States Patent
Toyoda et al.

(10) Patent No.: US 9,537,256 B2
(45) Date of Patent: Jan. 3, 2017

(54) CONNECTOR

(71) Applicants: Yazaki Corporation, Tokyo (JP); TOYOTA JIDOSHA KABUSHIKI KAISHA, Toyota-shi, Aichi-ken (JP)

(72) Inventors: Ryohei Toyoda, Makinohara (JP); Nobuyuki Sakamoto, Makinohara (JP); Takahito Nakashima, Okazaki (JP)

(73) Assignees: YAZAKI CORPORATION, Tokyo (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/741,967

(22) Filed: Jun. 17, 2015

(65) Prior Publication Data

US 2015/0372419 A1 Dec. 24, 2015

(30) Foreign Application Priority Data

Jun. 19, 2014 (JP) ..... 2014-126069

(51) Int. Cl.
*H01R 13/627* (2006.01)
*H01R 13/193* (2006.01)
*H01R 13/422* (2006.01)

(52) U.S. Cl.
CPC ..... *H01R 13/6272* (2013.01); *H01R 13/193* (2013.01); *H01R 13/4223* (2013.01)

(58) Field of Classification Search
CPC ..... H01R 13/6271; H01R 13/6272; H01R 13/6273
See application file for complete search history.

(56) References Cited

U.S. PATENT DOCUMENTS 8,246,374 B1 * 8/2012 Zhou ..... H01R 13/514 439/358
8,303,326 B1 * 11/2012 McKee ..... H01R 13/6275 439/358
8,602,809 B2 * 12/2013 Kyoyama ..... H01R 13/516 439/358
8,758,038 B2 * 6/2014 Kubo ..... H01R 13/6272 439/358
2003/0060075 A1 3/2003 Nakamura et al.

FOREIGN PATENT DOCUMENTS

JP 09-330764 A 12/1997
JP 2003-059571 A 2/2003

* cited by examiner

*Primary Examiner* — Gary Paumen
(74) *Attorney, Agent, or Firm* — Sughrue Mion, PLLC

(57) ABSTRACT

A connector includes a connector housing including a locking mechanism which locks a mating housing and formed to be fitted to the mating housing, and a connector terminal held by the connector housing to come into contact with a mating terminal held by the mating housing. The connector housing is designed to have a locking position of the connector housing with the mating housing by the locking mechanism and a contact position of the connector terminal with the mating terminal, and the locking position and the contact position coincide with or come close to each other in a fitting direction relative to the mating housing.

4 Claims, 3 Drawing Sheets

CONNECTOR

CROSS REFERENCE TO RELATED APPLICATIONS

This application is based upon and claims the benefit of priority of Japanese Patent Application No. 2014-126069 filed on Jun. 19, 2014, the contents of which are incorporated herein by reference in its entirety.

BACKGROUND OF THE INVENTION

1. Field of the Invention

The present invention relates to a connector which allows housings holding terminals to be fitted to each other so that the terminals are connected to each other.

2. Description of the Related Art

In a vehicle such as a motor vehicle, a connector is used which electrically connects a terminal connected to a plurality of electric wires of a wire harness to a mating component. The connector of this kind includes, for instance, a connector housing formed so as to be fitted to a mating housing which holds a mating terminal as a connection mate and one or a plurality of connector terminals which are held by the connector housing to come into contact with the mating terminal. In the connector housing, a locking mechanism which locks the mating housing is provided. In a state where the housings are locked with each other by the locking mechanism, the connector terminals are electrically connected to each other (see JP-A-2003-59571).

SUMMARY OF THE INVENTION

Since such kind of connector housing is formed with a synthetic resin, when a temperature changes, a volume change arises due to an expansion or a contraction of the resin, so that a change may possibly arises in a dimension in a fitting direction to the mating housing. When such a dimensional change arises, there is a fear that a contact position of the connector terminal and the mating terminal may be possibly shifted to deteriorate reliability in connection of the terminals. When a locking position of the connector housing and the mating housing is relatively distant from the contact position of the connector terminal and the mating terminal in the fitting direction of the housing, a range of the dimensional change of the housing which gives an influence to the contact position of the terminals is expanded. Accordingly, a shift in the contact position of the terminals is liable to be large. As a result, there is a fear that for instance, a friction arises between the terminals, so that plating on the surfaces of the terminals may possibly peel to cause rust in the connector terminal or increase an electric resistance to the mating terminal.

The present invention is devised by considering the above-described problems and a non-limited object of the present invention is to suppress a shift in a contact position of a connector terminal relative to a mating terminal due to a volume change of a connector housing.

An aspect of the present invention provides a connector including: a connector housing including a locking mechanism which locks a mating housing and formed to be fitted to the mating housing; and a connector terminal held by the connector housing to come into contact with a mating terminal held by the mating housing, wherein the connector housing is designed to have a locking position of the connector housing with the mating housing by the locking mechanism and a contact position of the connector terminal with the mating terminal, wherein the locking position and the contact position coincide with or come close to each other in a fitting direction relative to the mating housing.

According to the connector in the aspect of the present invention, since a variation of a position of the connector terminal due to the volume change of the connector housing at the time of a change of temperature can be reduced, a relative positional shift between the connector terminal and the mating terminal can be suppressed to stabilize a contact state of the terminals.

The connector may be configured such that the connector housing is extended in the fitting direction so as to be internally or externally fitted to the mating housing, and the locking mechanism of the connector housing includes a locking protrusion to be locked by an elastically deformable locking arm provided in the mating housing.

Alternatively, the connector may be configured such that the connector housing is extended in the fitting direction so as to be internally or externally fitted to the mating housing, and the locking mechanism of the connector housing includes an elastically deformable locking arm which locks a locking protrusion provided in the mating housing.

According to the aspect of the present invention, a shift in a contact position of a connector terminal relative to a mating terminal due to a volume change of a connector housing can be suppressed.

DETAILED DESCRIPTION OF THE EXEMPLARY EMBODIMENTS

Figure 1:
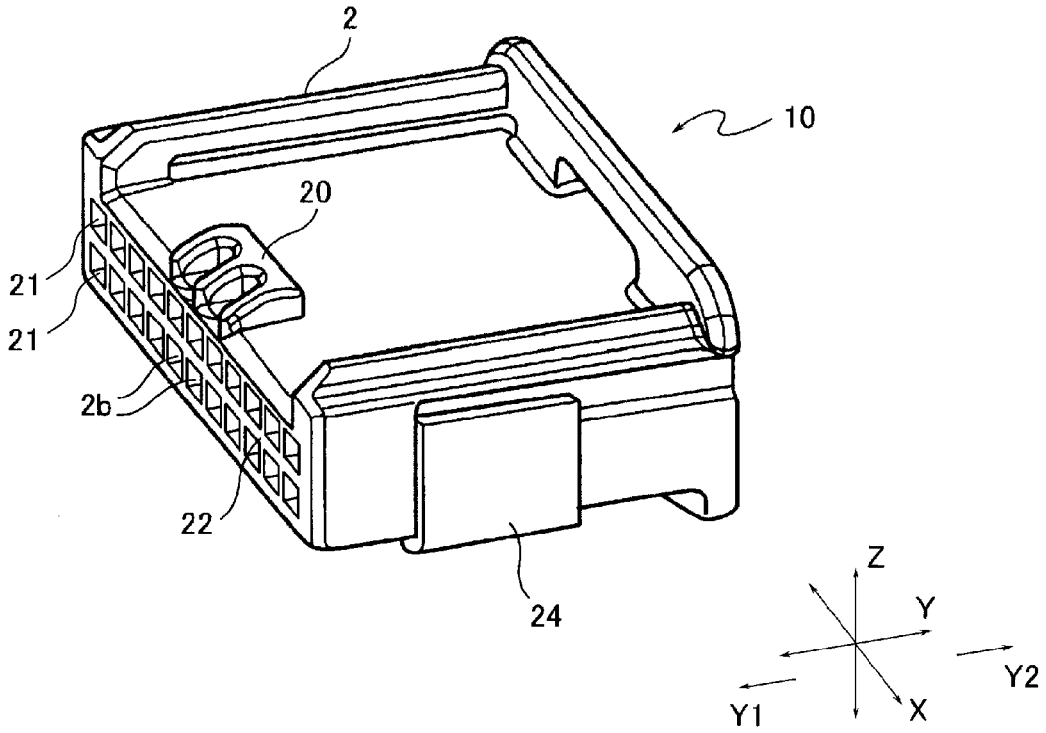
FIG. 1 is a perspective view showing an entire structure of a connector according to one exemplary embodiment of the present invention.
Figure 2:
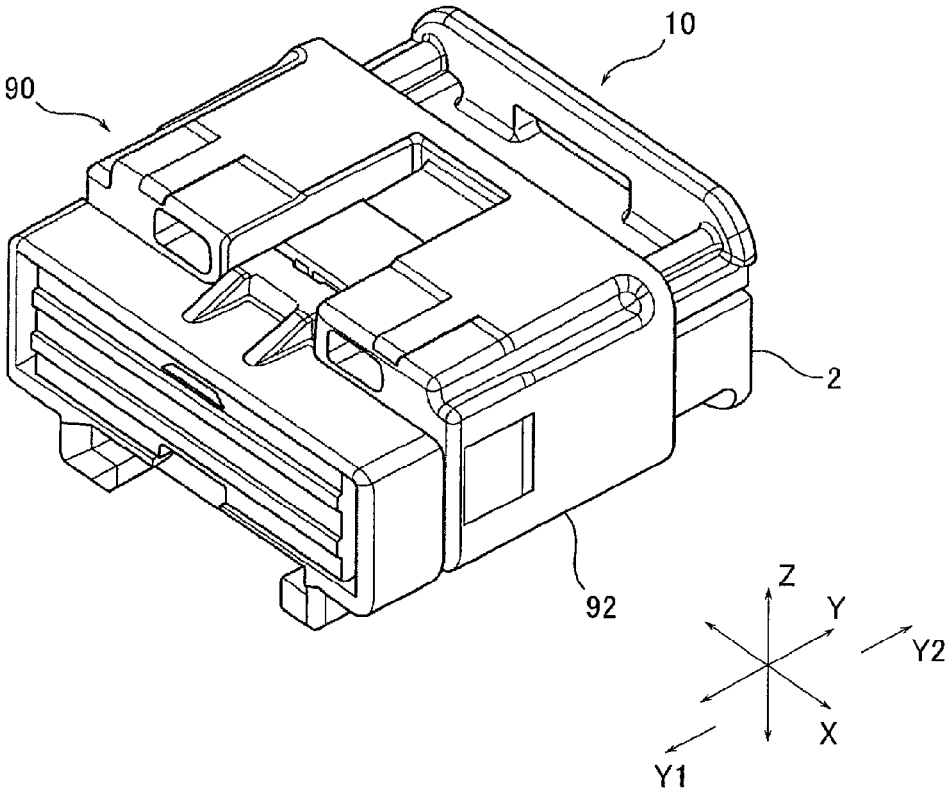
FIG. 2 is a perspective view showing a state that the connector according to the one exemplary embodiment of the present invention is fitted to a mating component.
Figure 3A:
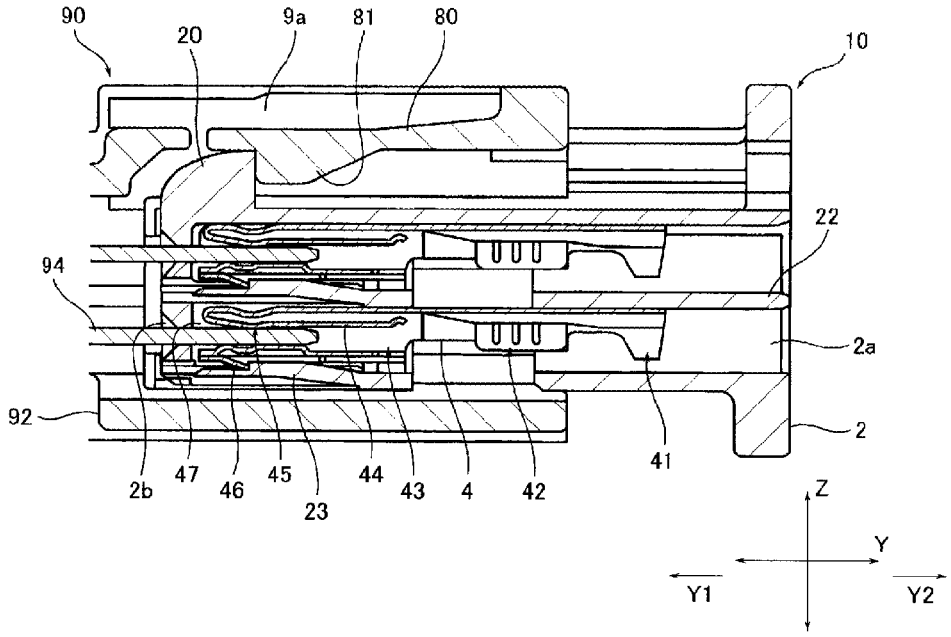
FIG. 3A is a longitudinally sectional view in a state that the connector according to the one exemplary embodiment of the present invention is fitted to the mating component.
Figure 3B:
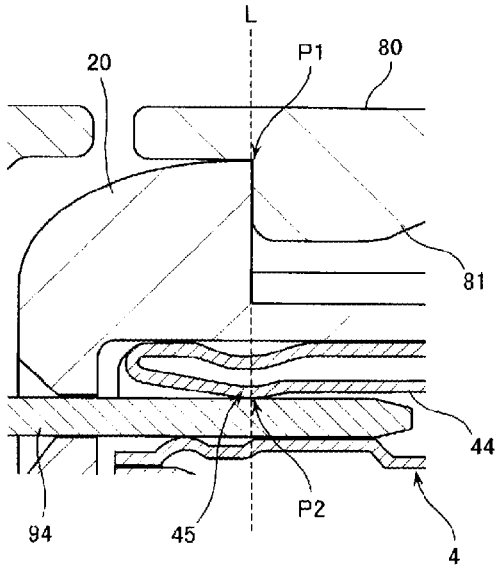
FIG. 3B is a partially enlarged view of FIG. 3A in a periphery of a locking position of a connector housing and a mating housing and a contact position of a connecter terminal and a mating terminal.

Now, a connector according to an exemplary embodiment of the present invention will be described below by referring to the accompanying drawings. FIGS. 1 to 3B show a structure of a connector 10 according to the one exemplary embodiment of the present invention. FIG. 1 is a perspective view showing an entire structure of the connector 10 according to the one exemplary embodiment of the present invention. FIG. 2 is a perspective view showing a state that the connector 10 is fitted to a mating component 90 to be connected. FIG. 3A is a longitudinally sectional view in such a fitted state, and FIG. 3B is a partially enlarged view of FIG. 3A. In a below-described explanation, a direction shown by an arrow mark X illustrated in FIGS. 1 to 3B is referred to as a transverse direction, a direction shown by an arrow mark Y is referred to as a longitudinal direction and a direction shown by an arrow mark Z is referred to as a vertical direction. The longitudinal direction thereof corresponds to a fitting direction of the connector 10 and the mating component 90. A direction shown by an arrow mark Y1 is taken as a front side (forward) and a fitting direction of the connector 10 and a direction shown by an arrow mark Y2 is taken as a rear side (rearward) and a fitting direction of the mating component 90.

The connector 10 includes a connector housing 2 fitted to a housing 92 of the mating component 90 (refer it to as a mating housing 92, hereinafter). The connector housing 2 is formed substantially in the shape of a square tube with a resin material having an insulating property which is extended in the fitting direction (the longitudinal direction) so as to be internally fitted to the mating housing 92. The connector housing 2 includes a locking mechanism which locks the mating housing 92 in a prescribed fitting position. In the present exemplary embodiment, as the locking mechanism, a locking protrusion 20 is provided which protrudes from a front end of an outer surface of an upper wall of the tube body. In this case, the mating housing 92 is a size larger than the connector housing 2 and formed substantially in the shape of a square tube with a resin material having an insulating material so as to internally fit the connector housing 2 thereto. In the mating housing 92, a locking arm 80 is provided which is extended from a rear end of an inner wall surface of an upper part of the tube body to the locking protrusion 20 and elastically deformable to lock the locking protrusion 20. The locking arm 80 is cantilever supported by the mating housing 92 and has a spring structure so that an end may be moved forward and backward to a recessed part 9*a* formed in the upper wall of the tube body. In an end of the locking arm 80, a protruding part 81 which protrudes downward is provided.

When the connector housing 2 is fitted to the mating housing 92, the locking protrusion 20 is allowed to abut on the protruding part 81 so that the locking arm 80 is bent upward and the connector housing 2 is inserted into the tube of the mating housing 92. Thus, the end of the locking arm 80 enters the recessed part 9*a* and the protruding part 81 rides on the locking protrusion 20. Then, when the protruding part 81 goes over the locking protrusion 20, the end of the locking arm 80 leaves the recessed part 9*a*. The locking arm 80 bent upward is returned to an original state and a rear end of the locking protrusion 20 is locked with a front end of the protruding part 81. As a result, the connector housing 2 is locked with the mating housing 92 together. The locking protrusion 20 is formed to be curved so as to be tapered toward a front end so that the protruding part 81 may easily ride on the locking protrusion 20. The protruding part 81 is formed in such a way that a rear end on which the locking protrusion 20 abuts when the connector housing 2 is inserted into the mating housing 92 is formed to be inclined so as to extend along the curved part of the locking protrusion 20.

Further, in the connector housing 2, terminal accommodating chambers 21 are provided in which respective connector terminals 4 are inserted from rear openings 2*a* and held. The terminal accommodating chambers 21 are provided in accordance with the number of the connector terminals 4. The terminal accommodating chambers 21 which are mutually adjacent in upper, lower, right and left positions are divided by partition walls 22. In the connector housing 2 shown in FIG. 1, eleven terminal accommodating chambers 21 are arranged in the transverse direction and respectively in two stages of upper and lower parts. In each terminal accommodating chamber 21, a lance 23 which locks the connector terminal 4 is provided to extend forward (in an inserting direction of the connector terminal 4) from an inner wall surface of a bottom side. The lance 23 has a cantilever type spring structure to lock the connector terminal 4 by a restoring force from a resilient deformation so as to prevent the connector terminal 4 from being slipped off from the terminal accommodating chamber 21 and hold the connector terminal 4. Further, to the connector housing 2, a retainer 24 is attached from a lower part in order to more assuredly prevent the connector terminal 4 held in the terminal accommodating chamber 21 from being slipped off.

The connector terminal 4 is formed by press working a metal sheet having an electric conductivity and attached to an insulating part of a terminal of an electric wire (an illustration is omitted) in a barrel part 41 of a base end side by caulking and to a conductor part of the terminal of the electric wire in a connection part 42 nearer to an end part than to the barrel part 41 by crimping. In the end of the connector terminal 4, a tubular contact point part 43 into which a mating terminal 94 held by the mating housing 92 is inserted is formed to be connected to the connection part 42. The contact point part 43 has a resiliently deformable resilient piece 44 which is formed in such a way that an upper wall of the tubular body is folded back inside and extended rearward (an inserting direction of the mating terminal 94). The resilient piece 44 has a cantilever type spring structure and has a protruding part 45 which protrudes downward pressed to the mating terminal 94 inserted into the contact point part 43 so that the protruding part 45 may come into contact with the mating terminal 94. Further, in the contact point part 43, a locking piece 46 which can be locked with the lance 23 is formed rearward (a slipping direction of the connector terminal 4) so as to be obliquely inclined downward from a lower wall of the tubular body.

The connector terminal 4 formed in such a way as described above is attached to the terminal accommodating chamber 21 as shown in FIG. 3A. In this case, the contact point part 43 is allowed to abut on the lance 23 so that the lance 23 is bent downward and the connector terminal 4 is inserted into the terminal accommodating chamber 21. When the connector terminal 4 is inserted to a prescribed position, the lance 23 is resiliently returned and deformed to return to an original state and locked with the locking piece 46. Thus, the connector terminal 4 is locked in the lance 23 and attached to the terminal accommodating chamber 21. When the electric wire (an illustration is omitted) attached to the connector terminal 4 in the barrel part 41 and the connection part 42 is pulled rearward, a force is applied to the connector terminal 4 in a direction in which the locking piece 46 is locked with the lance 23, so that the connector terminal 4 is attached to the terminal accommodating chamber 21 in a state where the connector terminal 4 is strongly locked with the lance 23. In the attached connector terminal 4, a mating terminal insert opening 47 of the contact point part 43 is allowed to face from an opening 2*b* in a front part of the connector housing 2.

When the mating terminal 94 is inserted from the mating terminal insert opening 47 through the opening 2*b* of the connector housing 2, the contact point part 43 comes into contact with the mating terminal 94 in a state where the protruding part 45 of the resilient piece 44 is pressed to the mating terminal 94. Thus, the connector terminal 4 is electrically connected to the mating terminal 94.

In a state where the connector terminal 4 is electrically connected to the mating terminal 94, as shown in an enlarged view in FIG. 3B, a position P1 where the locking protrusion 20 of the connector housing 2 is locked with the protruding part 81 of the locking arm 80 of the mating housing 92 coincides with a position P2 where the protruding part 45 of the resilient piece 44 of the connector terminal 4 comes into contact with the mating terminal 94 in the fitting direction (the longitudinal direction) of the housings (the positions P1 and P2 are located so as to be aligned on an alignment line L which is perpendicular to the fitting direction of the housings).

Accordingly, a distance between the position P1 and the position P2 in the fitting direction is zero. Thus, a relative moving distance between the position P1 and the position P2 due to a volume change of the connector housing 2 can be reduced during the change of temperature. Accordingly, a shift in position between the connector terminal 4 and the mating terminal 94 can be suppressed, so that a contact state of the terminals can be stabilized. As a result, since a peeling of a plating in the contact part due to, for instance, a friction between the connector terminal 4 and the mating terminal 94 can be prevented, so that an inconvenience such as a generation of rust in the connector terminal 4 or an increase of an electric resistance to the mating terminal 94 can be effectively avoided from occurring. Accordingly, an electric reliability of the connector 10 can be increased.

The present invention is described above in accordance with the one exemplary embodiment as shown in FIGS. 1 to 3B; however, the above-described exemplary embodiment merely shows one example of the present invention and the present invention is not limited thereto.

For instance, in the present exemplary embodiment, the position P1 is made to coincide with the position P2 in the fitting direction. However, the positions P1 and P2 do not need to precisely coincide with each other in the fitting direction. Even when the positions P1 and P2 are not separated from each other and are located to come close to each other (located in the vicinity of the alignment line L shown in FIG. 3B), an effect of suppressing the shift in position between the connector terminal 4 and the mating connector 94 can be also obtained.

Further, in the present exemplary embodiment, the connector housing 2 is used as a male side housing and the mating housing 92 is used as a female side housing to internally fit the connector housing 2 to the mating housing 92. However, the male and female sides may be reversed to externally fit the connector housing to the mating housing. Similarly, the connector terminal 4 is used as a female terminal and the mating terminal 94 is used as a male terminal (an electrically conductive metal member such as a linearly extending rod type member). Conversely, the connector terminal may be set as a male terminal and the mating terminal may be set as a female terminal. In addition thereto, the male and the female of the housings and the male and the female of the terminals respectively held by the housings may be respectively different from each other as in the present exemplary embodiment and may be respectively made to correspond to each other.

Further, in the present exemplary embodiment, as the locking mechanism, the locking protrusion 20 is provided in the connector housing 2 and the locking arm 80 which locks the locking protrusion 20 is provided in the mating housing 92. Alternatively, the locking protrusion may be provided in the mating housing and the locking arm may be provided in the connector housing. The locking mechanism is not limited to the above-described locking protrusion and the locking arm. For instance, a locking protrusion and a locking opening which locks the locking protrusion in an opening edge may be used.

What is claimed is:

1. A connector comprising:

a connector housing including a locking mechanism which locks a mating housing; and a connector terminal comprising a protruding part, the connector terminal being held by the connector housing to contact a mating terminal held by the mating housing via the protruding part, wherein the connector housing is inserted into the mating housing;

the protruding part is raised from a long surface of the connector terminal; and the connector housing is designed to have a locking position of the connector housing with the mating housing by the locking mechanism and a contact position of the connector terminal with the mating terminal, wherein the locking position and the contact position are located so as to be aligned on a line which is perpendicular to a fitting direction relative to the mating housing.

2. The connector according to claim 1, wherein the connector housing extends in a fitting direction with the mating housing, and the locking mechanism of the connector housing includes a locking protrusion to be locked by an elastically deformable locking arm provided in the mating housing.

3. The connector according to claim 1, wherein the connector housing extends in a fitting direction with the mating housing, and the locking mechanism of the connector housing includes an elastically deformable locking arm which locks a locking protrusion provided in the mating housing.

4. The connector according to claim 1, wherein the connector terminal further comprises a locking piece, and the connector housing further comprises a lance; wherein the locking piece is locked to the lance.

* * * * *